United States Patent [19]

Gordon et al.

[11] Patent Number: 4,686,109

[45] Date of Patent: Aug. 11, 1987

[54] METHOD FOR CONVERTING AND MAINTAINING A FABRIC MATERIAL IN A FIRE RETARDANT, HEAT RESISTANT STATE

[76] Inventors: Arnold Z. Gordon, 5139 Mayview Rd., Lindherst, Ohio 44124; Lyle A. Cohen, 380 Russet La., Highland Park, Ill. 60035

[21] Appl. No.: 865,096

[22] Filed: May 20, 1986

Related U.S. Application Data

[63] Continuation-in-part of Ser. No. 541,920, Oct. 14, 1983, abandoned.

[51] Int. Cl.[4] ..... B05D 3/02; B05D 3/06; C09D 5/16; C09D 5/18

[52] U.S. Cl. ..... 427/36; 106/18.24; 106/18.26; 106/18.35; 427/377; 427/393.3

[58] Field of Search ..... 106/18.24, 18.25, 18.26, 106/18.35; 252/608; 423/164, 166; 427/393.3, 377, 36

[56] References Cited

U.S. PATENT DOCUMENTS 3,741,929 6/1973 Burton ..... 106/18.26 X
4,401,698 8/1983 Tripp ..... 427/393.3 X

FOREIGN PATENT DOCUMENTS 3028254 2/1982 Fed. Rep. of Germany ... 106/18.26

*Primary Examiner*—Michael R. Lusignan
*Attorney, Agent, or Firm*—Dick and Harris

[57] ABSTRACT

A method for converting and maintaining a fabric material in a fire retardant state through the steps of integrating a substantially non-toxic hydrophilic substance amidst the fibers of a fabric material where the hydrophilic substance is possessed of reversible hydration characteristics towards absorbing water in a non-heat or fire environment and alternatively releasing water in a heat or fire environment. The hydrophilic material is further capable of being reversibly restored to a further fire retardancy after the alternative release of water in a heat-fire environment. The steps embodied by the method include hydrating the incorporated hydrophilic material to a desired level of hydration at equilibrium in which the fire retardant material preferably comprises a hydrogel substance which not only releases at a "safe", relatively low, triggering temperature, with a substantially high water retention capability—to reduce or eliminate the ability of such a treated fabric to sustain a flame or high levels of heat, in which the fire retardant itself is a poly (acrylic acid), poly (ethylene oxide) or carbox (polyethylene oxide (PEO)) methyl cellulose compound or the like.

7 Claims, No Drawings

METHOD FOR CONVERTING AND MAINTAINING A FABRIC MATERIAL IN A FIRE RETARDANT, HEAT RESISTANT STATE

BACKGROUND OF THE INVENTION

The present application is a Continuation-In-Part of application Ser. No. 06/541,920, filed 10-14-83, now abandoned.

The present invention relates to fire retardants in general, and specifically to a method for converting and maintaining a fabric material in a fire retardant state.

Materials, including fabrics which resist burning or exposure to high heat are desirable for many applications. In heavy industries splashing molten metal frequently sets fire to workers clothing. The resulting injuries and deaths are attributable at least as much to the burning clothing as to the contact of the hot metal with workers' flesh. Clothing that resists burning and transmission of high heat levels in such circumstances would greatly reduce the severity of worker injuries. Additionally flame and high temperature resistant fabrics and materials are desirable for use in furnishings and decorations in public accommodations and in public transit vehicles including airplanes. The death toll from smoke caused by burning plastics in hotel fires or airplane crashes has drawn regulatory attention to the properties of products used in these facilities. Children's sleepwear is also a particular concern, as are items such as carpet backings.

The problem of making fabrics or plastics flame retardant and/or heat resistent has been approached by adding chemicals to the material. One group of chemical additives are alumina hydrates, typically alumina trihydrate ($Al_3O_33H_2O$). Hydrated magnesia and hydrated calcium silicalate may also be used according to U.S. Pat. No. 4,349,605 of Biggs. These chemicals reduce flamability because, when they are heated, they chemically decompose, releasing the water molecules which turn to steam. The evaporation of the water reduces the temperature of the treated material and therefore retards the spread of flame. Additionally the steam reduces the oxygen concentration of the atmosphere immediately surrounding the flame thereby reducing its intensity. The release of water in these processes is generally irreversible and requires heating to an unsafe elevated water release triggering temperature, where the chemicals are incapable of retaining an effective volume of water.

Another group of flame retardant additives are halogen compounds. These may be added to poly propoylenes and polystyrenes. Typically these additives contain 20–40% chlorine and 30–45% bromine. Apparently these compounds operate by interrupting the chain reactions necessary for continuous burning in the gas phase. Although these additives do have efficacy in retarding flame, they can produce toxic by-products such as hydrogenchloride upon thermal decomposition. Thus the flame spread may be reduced, but the toxic gases may be more harmful than allowing the fire to spread.

Other groups of flame retardant additives are based on antimony-oxide and phosphorous compounds. Both of these tend to reduce flammability, but also have undesirable side effects including the production of toxic by-products. For example phosphorous products may produce bicyclic phosphate, a gas which is highly toxic.

Likewise, antimony is released when the antimonyoxide compounds decompose, and the results are highly toxic.

A final product relevant to the present invention is a neoprene and fiberglass matress manufactured by Sealey. Upon ignition, a layer of neoprene foam releases moisture and forms an insulating layer of char. It is believed that this process is a thermal chemical decomposition process and is therefore generally irreversible.

SUMMARY OF THE INVENTION

The present inventive method overcomes many of the difficulties and disadvantages of the prior art techniques for making fire retardant and heat resistent materials and fabrics. Specifically, the present invention operates by means of a reversible process that does not involve chemical decomposition of the material to achieve flame retardancy. Moreover, there are no toxic by-products should the material of the present invention be heated to the point of thermal decomposition.

The present invention achieves these goals by using a hydrophilic substance such as calcium sulphate hydrate or lightly crosslinked hydrogels such as poly (acrylic acid). Such hydrophilic materials readily and repeatably absorb moisture and give it up without undergoing a chemical decomposition. The hydrophilic material may be applied as a coating or incorporated directly into the material to be treated. According to the invention, the hydrophilic material may be laminated with layers of hydrophilic material alternating with layers of the material to be treated or otherwise impregnated into the fabric fibers. The invention may be used alone or in combination with other known fire retardants. Finally the gas released could be other than steam. For example the gas could be carbon dioxide ($CO_2$), and the hydrophilic material could be $CaCO_3$, $MgCO_3$, $ZnCO_3$, Mg CA $(CO_3)_2$ or bicarbonates of these such as, for example, Ca $(HCO_3)_2$.

The preferred embodiment of the invention encompasses a method for converting and maintaining such fabric materials in a fire retardant, high heat, resistent state. The method includes the steps of firstly, integrating a substantially non-toxic hydrophilic substance amidst the fibers of the fabric material. The hydrophilic substance integrated amidst these fibers is operably possessed of reversible hydration characteristics which enable the absorption of water in a non-high heat or fire environment, and the alternative release of water in a higher heat or fire environment. The release of water or moisture is initiated at a temperature ranging from 100° to 300° F., to effectively trigger, at as low a high heat temperture as possible, the release of water towards retarding the heat or fire environment without requiring exposure to substantially high temperatures, in excess of 500° F. for example, for the initiation of the protective moisture release. The substantially hydrophilic substance integrated amidst the fabric material fibers is capable of reversibly hydrating with water from at least 40% to more than 99% of the combined weight (resin plus water) thereof, with the hydrophilic material being further capable of being reversibly restored to a further fire retardancy state after the alternative release of moisture or water in the high heat or fire environment, providing damage and decomposure of the fabric material fibers has not occurred. The method for converting and maintaining the fabric material in a fire retardant heat resistent state further includes the step of hydrating the incorporated hydrophilic material to the desired level of hydration at equilibrium through any one of several means of material hydration.

DESCRIPTION OF THE PREFERRED EMBODIMENTS

While this invention is susceptible of embodiment in many different forms and will herein be described in detail, several specific embodiments, with the understanding that the present disclosure is to be considered as an exemplification of the principles of the invention and is not intended to limit the invention to the embodiments disclosed.

The present invention comprises a method for converting and/or maintaining a material or fabric in a fire retardant, heat resistent condition, by incorporating into it, a hydrophilic material which readily absorbs and gives up moisture without undergoing a chemical decomposition, while repeatedly reversible to moisture absorption and release conditions. One preferred hydrophilic material is calcium sulphate hydrate. This may be applied in a slurry by combining it with $CH_2Cl_2$ and a polymeric binding agent such as polymethylmethacrylate (PMMA). Another preferred material is a high molecular weight polymer poly (acrylic acid). The slurry may be applied to the material by spraying or dipping the material.

An alternative to application of the polymeric material as a slurry is to include it into the initial materials formulation, for example, as a filler in yarns or threads or in the formulation of plastics. The amount of such a hydrophilic material can be selected according to the amount of fire retardancy required. Moreover other compositions of the hydrophilic material are possible.

A fabric is treated with the above processes either before or after being formed into finished products such as industrial protective clothing or curtains. Such products could also be made as a sandwich, with a layer of treated, fire retardant material between outer layers of untreated materials. In either case, upon being heated, the treated material gives off steam, initially at exposed temperatures of 150° to 300° F., thus reducing the temperature of the material at an early stage of elevated temperature, while decreasing the oxygen concentration in the surrounding atmosphere.

Because this water release process is repeatedly reversible (as long as fabric composition is not damaged), the garment or article may be immersed in water and dried to the desired amount to restore its fire retardancy. Thus the fire retardancy of children's sleepware is assured after each laundering, and a welder's apron could be restored to full effectiveness in the same way. Moreover the amount and type of hydrophilic material included in a garment may be selected to absorb an effective amount of moisture from the atmosphere, or, if in the form of a garment, from perspiration of the wearer.

As an alternative to water as a fire retardant gas, compounds which release carbon dioxide may be used. In this case the retardant could be selected from the group of carbonates including CA $CO_3$, Mg $CO_3$ $ZnCO_3$, MgCa $(CO_3)_2$, or the bicarbonates of these such as Ca $(HCO_3)_2$. Bicarbonates release both water and carbon dioxide upon being heated, but would not be readily restored to retardancy after being heated.

Testing has indicated excellent results in rendering test swatches of material, non-flammable or much less flammable than the untreated fabric. The following mixtures have been used. Unless otherwise specified all percentages are percent by weight.

1. 0.5% Carbapol/940. Carbapol/940 is available from B. F. Goodrich in the form of a white powder. This resin is a high molecular weight poly (acrylic acid) in an acid form. It was mixed with water and a salt (NaCl) solution to neutralize it and convert it to a salt form. This mixture is a stiff gel.

2. 0.1% Carbapol. This mixture is the same as No. 1 above, but five times more dilute. This mixture is a flowable liquid.

3. 2½% Carbapol. This mixture is like Nos. 1 and 2, but more concentrated.

4. 0.5% Poly-Ox Coagulant. This resin is available from Union Carbide as a dry free flowing white powder. It is a high molecular weight poly (ethylene oxide) also called PDO. It is a non-ionic resin and is relatively less sensitive to salts than Carbapol which includes negatively charged sites. The resin was mixed with water to form a 0.5% solution.

5. 0.5% Poly-Ox Coagulant plus 0.019% Carbapol 940. This is a mixture 25 to 1 of carbapol 940 and Poly-Ox Coagulant, with water.

6. 0.5% Carbapol 940. This mixture is the same as No. 1 but with no salts added so that the resin remains in acid form.

7. 9.5% Carbapol 940 plus 0.022% Poly-Ox Coagulant. This mixture is similar to 5 but with quantities reversed and is an extremely viscous solution.

8. 1% Carbose D-72. This semisynthetic resin is supplied by Carbose Corporation of Somerset, Pa. 15501, and is also called carbox methyl cellulose. When mixed with water, it formed a thick, off-white solution/mixture.

Swatches, about two inches square of commercially available cotton fabric were treated with each of the mixtures above by thoroughly wetting each swatch and allowing it to dry at atmospheric conditions until equilibrium was reached. Each was then rehydrated by being exposed to 100% relative humidity until equilibrium or near equilibrium was reached. The rehydrated swatches were tested for combustability by exposing them to an open flame. The table below (Table 1) sets forth the combustibility results observed for swatches treated with various mixtures at various states of hydration.

TABLE 1

| MIXTURE | % $H_2O$ OF TREATED SWATCH | SATURATED | COMBUSTIBLE |
|---|---|---|---|
| None | 0% | NO | YES |
| None | 6 | NO | YES |
| 1 | 15 | YES | NO |
| 3 | 20 | YES | NO |
| 8 | 26 | YES | NO |
| 4 | 34 | YES | NO |
| 4 | 9 | NO | YES |
| 5 | 16 | PROBABLY | YES |
| 7 | 17 | PROBABLY | MARGINAL |

It appears from the above that for Carbapol treated material hydration of about 15% water by weight produces a fabric which will not burn. Moreover each of the fabric swatches treated with the resin mixtures was subjected to dehydration and rehydration cycles, and none showed any degradation of performance.

Additional tests were made mixing the alumina hydrate (C330 available from Alco Aluminum) which is a conventional fire retardant with a hydrogel according to the present invention. One mixture, No. 9, was about 58% alumina hydrate, 0.22% Carbapol and the balance water. Another mixture, No. 10, was about 5.4% alumina hydrate, 0.47% Carbapol and the balance water. When a swatch treated with mixture No. 9 was hydrated to about 3% water, it was found to be noncombustible. When a swatch treated with mixture No. 10 was rehydrated to 15% water, it was found to be marginally combustible. Thus it is clear that the polymeric mixtures of the present invention also work together with conventional fire retardants.

In addition, tests have shown that basal perspiration can provide enough moisture to maintain fabric treated in accordance with this invention in a fire retardant state. Cotton toweling was treated with mixture No. 1 above to about 1½% by weight of resin. When kept close to a resting person's flesh, it became sufficiently hydrated to be noncombustible. A control sample of untreated material burned readily.

Although specific examples above have been given, the present invention contemplates that other hydrogels could also be used. For example suitable hydrogels may be made from poly (hydroxyalkylmethacrylate), poly (methacrylic acid), poly (acrylic acid), poly (N-vinyl pyrrolidone), poly (vinyl alcohol), poly (ethylene oxide), hydrolized poly (acrylonitrile), natural gums and resins, cellulosic compounds and polyelectrolyte complexes. Further, salts, homologs, derivatives and combinations of the above may be used.

Other polymeric ethers may also prove useful, as may hydrogels made from poly (vinyl methyl ether), copolymers of malpic anhydride and ethylene and copolymers of malcic anhydride and vinyl methyl ether.

Other potential hydrogel precursors and stabilizers are listed in U.S. Pat. No. 3,993,551 and 3,664,343 of Assarsson, which are incorporated herein by reference.

Further it is contemplated that additional materials such as other stabilizers, e.g., poly (ethyleneimine), biostats or fungicides may be added to the mixtures used to treat fabrics according to the present invention.

Mixture No. 1 above has also been used to control or eliminate combustability of plastics. For example, mixture No. 1 was mixed separately with neocrol 622 and 623 acrylic copolymers available from Polyvinyl Chemical Ind., Wilmington, Mass. and separately with Qw 4479 and Qw 4391 modified aliphatic urethanes by Quinn and Company of Malden, Mass. In all cases with less than 0.7% resin by weight, the plastic was rendered incombustible, that is, it would not support a flame by itself. In every case the untreated plastic would burn easily.

The present invention particularly permits initiation of water release at relatively lower, "safer", ranges of heat, such as from 150° to 300° F. towards safely retarding the dangers of heat and fire without requiring exposure to temperatures in excess of 500° F. (such as required by alumina hydrate) ——with the present hydrophilic substance being capable of reversibly hydrating with water to at least 40% of its integrated (resin plus water) weight.

In association with the invention's "triggering" water vapor release temperature, experiments were conducted on untreated cotton fabric, cotton fabric treated with the present Carbapol solution, and lastly alumina trihydrate.

Cotton fabric swatches (approximately 2"×2") were wetted with distilled water and gently "toweled dry" with a paper towel until the swatches were wet but not dripping moisture. Half of the swatches had been precoated with fully pH neutralized Carbapol 940 (Mixture No. 7 hereinabove) by dip coating in an aqueous solution of same and allowing the swatches to dry in room air for 72 hours. The damp swatches and the hydrated alumina samples were then placed in a small oven for one minute at a set temperature (as per Table 2). The weight change of the heating procedure was recorded and the percentage of the room temperature water retained by the material was determined.

TABLE 2

| | Water Retention vs. Temperature | | | |
|---|---|---|---|---|
| T(F.) | T(C.) | 1. Untreated Fabric | 2. Treated Fabric | 3. Hydrated Alumina |
| 68° | 20° | 100% | 100% | 100% |
| 86° | 30° | 69% | 97% | 100% |
| 104° | 40° | 43% | 94% | 100% |
| 122° | 50° | 18% | 90% | 100% |
| 140° | 60° | 0% | 84% | 100% |
| 158° | 70° | 0% | 81% | 100% |
| 176° | 80° | 0% | 63% | 100% |
| 194° | 90° | 0% | 45% | 100% |
| 212° | 100° | 0% | 21% | 100% |

It is important to remember that 22° C. is approximately room temperature, 37° C. approximately body temperature, and 100° C. the temperature of scalding water or steam, with the latter temperature being capable of promptly producing very serious burns inclusive of third degree burns.

The first column of Table 2 is the percentage of the room temperature water retained by untreated cotton ("undershirt", freshly laundered) at various temperatures. The data shows that this material has little or no tendency to retain useful amounts of water and promptly looses what little moisture it does retain, resulting in an insignificant protection against fire.

The third column is the dehydration behavior of the alumina hydrate sample. It showed no water loss up to and including 100° C., inasmuch as this material does not release its moisture until temperatures in excess of approximately 600° F. (300° C.) are reached. Materials treated with such compounds could permit destruction of underlying tissue regions before the retained moisture was released.

The second column depicts the behavior of the hydrogel coated cotton fabric (with Carbapol Mixture No. 7), in which water vapor is principally released between approximately 70° C. -100° C. (158° F.-212° F.). Such a garment would retain its moisture in the warm or hot environments associated with fires (unlike untreated fabric), but would readily release that moisture if the temperature of the garment got so hot as to pose a health risk to the underlying tissues. The exact thermal curve for such treated fabric is, of course, subject to adjustment by altering the composition of the hydrogel and the details of application.

With regard to the retention capacity of reversible hydration, in which two experiments were performed, cotton swatches were again treated with resin and wetted. The weight change over several hours was measured and the percentage of retained water was determined. For comparison, the retention capacity of hydrated alumina is approximately 35% water by weight.

In the first experiment, a 2.31 gram swatch of cotton was coated with 0.0278 grams of fully pH neutralized Carbapol 90 resin. The percentage of water in the resulting hydrogel (resin +water =hydrogel) was recorded at room temperature, in still air, over a period of several hours. Additionally, a swatch of untreated cotton fabric was run as a control to account for any moisture which might be retained by the cotton fabric itself. All reported values are above this baseline value, that is the water held by untreated cotton has been subtracted before the % water in the hydrogel was calculated.

TABLE 3

| | Hydrogel Composition Carbapol #940 | | | |
|---|---|---|---|---|
| | 0 Hours | 1 Hours | 2.5 Hours | 5 Hours |
| Resin | .0278 g | .0278 g | .0278 g | .0278 g |
| $H_2O$ | 4.38 g | 3.73 g | 3.21 g | 1.64 g |
| % $H_2O$ | 99.4% | 99.3% | 99.1% | 98.3% |

TABLE 4

| | Hydrogel Composition Poly-Ox Coagulant Grade | | |
|---|---|---|---|
| | 0 Hours | 6.5 Hours | 8 Hours |
| Resin | .040 g | .040 g | .040 g |
| $H_2O$ | 5.98 g | 3.51 g | 2.73 g |
| % $H_2O$ | 99.3% | 98.9% | 98.6% |

As may be seen from the above data of Tables 3 and 4 (again, in which Mixture No. 7 was utilized), hydrogels are principally water, with the present invention describing a preferred range of water composition of approximately 40%–99.9% water by weight, and even preferably a range of 50%–95% water by weight. These values may be compared to the water retention capacity of hydrated alumina, which is approximately only 35%.

The resin may be applied to the textile as a coating or incorporated into the composition of the yarn. Additionally, the resin may be chemically bonded to the yarn material or crosslinked via chemical or radiation means. The chemical means would include polymerization with polyfunctional agents and chemical reaction with polyfunctional agents such as the reaction of carboxylic hydrogels with polyimines. The radiation crosslinking may be accomplished by irradiation with ionizing radiation such as gamma rays.

While Carbapol, lightly crosslinked poly (acrylic acid), has been utilized as one hydrogel substance, other hydrogels such as polyethylene amine (CCN) may alternatively be used to avail the fire retardancy benefits of nitrogen. Various combinations of these substances would assist in fabric retention of the hydrogel, where two different polymers may be crosslinked to each other, such as where polymeric quaternary amines crosslink excellently with Carbapol.

The foregoing description merely explains the invention and the invention is not limited thereto, except insofar as the amended claims are so limited as those skilled in the art who have the disclosure before them will be able to make modifications and variations therein without departing from the scope of the invention.

What is claimed is:

1. A method for converting and maintaining a fabric material in a fire retardant, heat resistent state, said method including the steps of;

A. integrating a substantially non-toxic hydrophilic substance amidst the fibers of said fabric material, said hydrophilic substance integrated amidst said material fibers being operably possessed of reversible hydration characteristics towards the absorption of water in a non-heatfire environment and the alternative release of water in a heatfire environment, said hydrophilic substance capable of releasing water in said heat-fire environment initiating at a temperature ranging from 150° F. to 300° F., towards safely retarding the dangers arising out of said heat-fire environment, without requiring exposure to substantially high temperatures in excess of 500° F. for initiation of said water release, said substantially hydrophilic substance integrated amidst said fabric material fibers also being capable of reversibly hydrating with water to at least forty percent of the combined weight thereof;

said hydrophilic substance being further capable of being reversibly restored to a further fire retardant heatresistent state after said alternative release of water in said heat-fire environment, in the absence of damage and decomposure of the structure of said fabric material fibers;

B. hydrating said incorporated hydrophilic substance to said desired level of hydration, at equilibrium, through material hydration means.

2. A method as set forth in claim 1 wherein said substantially hydrophilic substance is a hydrophilic material selected from the group consisting of calcium sulphate hydrates and hydro- gels.

3. The method as set forth in claim 1 wherein said step of integrating the hydrophilic substance includes the step of including said hydrophilic substance in the original formulation of a synthetic material.

4. The method as set forth in claim 1 in which said hydrophilic substance comprises a slurried material formed from a substance selected from the group consisting of $CH_2Cl_2$ together with a polymeric binding action.

5. The method as set forth in claim 1 wherein said steps of integrating said hydrophilic substance amidst said fabric material is accomplished through the step of immersing said fabric material into a liquid form of hydrophilic substance and, thereafter, removing the liquid element of said hydrophilic substance therefrom the overall fabric material.

6. The method as set forth in claim 1 wherein said steps of integrating said hydrophilic substance amidst said fabric material is accomplished by chemically bonding said hydrophilic substance through the chemical reaction of carboxylic hydrogels with polyimines.

7. The method as set forth in claim 1 wherein said steps of integrating said fabric material is accomplished by chemically bonding said hydrophilic substance through irradiation with ionizing gamma rays.

* * * * *